US009937716B2

(12) United States Patent
Mikoshiba et al.

(10) Patent No.: US 9,937,716 B2
(45) Date of Patent: Apr. 10, 2018

(54) ELECTRONIC DEVICE, LIQUID EJECTING HEAD, AND ELECTRONIC DEVICE MANUFACTURING METHOD

(71) Applicant: SEIKO EPSON CORPORATION, Tokyo (JP)

(72) Inventors: Masanori Mikoshiba, Shimosuwa-machi (JP); Yasuyuki Matsumoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/273,420

(22) Filed: Sep. 22, 2016

(65) Prior Publication Data

US 2017/0087843 A1 Mar. 30, 2017

(30) Foreign Application Priority Data

Sep. 25, 2015 (JP) ..... 2015-187840

(51) Int. Cl.
*B41J 2/14* (2006.01)
*B41J 2/16* (2006.01)

(52) U.S. Cl.
CPC ..... *B41J 2/14209* (2013.01); *B41J 2/14233* (2013.01); *B41J 2/161* (2013.01); *B41J 2/1628* (2013.01); *B41J 2/1629* (2013.01); *B41J 2/1631* (2013.01); *B41J 2002/1425* (2013.01); *B41J 2002/14241* (2013.01)

(58) Field of Classification Search
CPC ..... B41J 2/161; B41J 2/14233; B41J 2/1612; B41J 2/1623; B41J 2/14209; B41J 2/1631; B41J 2/1629; B41J 2/1628; B41J 2002/1425; B41J 2002/14241
See application file for complete search history.

(56) References Cited

U.S. PATENT DOCUMENTS

| | | | | |
|---|---|---|---|---|
| 2004/0027424 | A1* | 2/2004 | Kim | B41J 2/1603 347/64 |
| 2012/0182360 | A1 | 7/2012 | Ito et al. | |
| 2014/0002550 | A1 | 1/2014 | Ito et al. | |
| 2015/0042729 | A1* | 2/2015 | Munakata | B41J 2/1606 347/85 |

FOREIGN PATENT DOCUMENTS

| | | | | |
|---|---|---|---|---|
| JP | 11-227190 | * | 8/1999 | B41J 2/045 |
| JP | 2000-103059 | | 4/2000 | |
| JP | 3555653 | | 5/2004 | |
| JP | 2016-027961 | | 2/2016 | |

* cited by examiner

*Primary Examiner* — Henok Legesse
(74) *Attorney, Agent, or Firm* — Workman Nydegger

(57) ABSTRACT

An electronic device includes a plurality of substrates joined together in a stacked state, a space formed in one substrate out of the plurality of substrates, and a movable region configured by one face out of faces bounding the space. The movable region includes a recess indented from a space side to partway along a thickness direction of the movable region. An internal dimension of the recess in a direction perpendicular to a substrate stacking direction is larger than an internal dimension of the space in the direction perpendicular to the substrate stacking direction, and a wall bounding the space in the one substrate, and at least a portion of a bottom face of the recess, are adhered together by an adhesive.

6 Claims, 6 Drawing Sheets

ELECTRONIC DEVICE, LIQUID EJECTING HEAD, AND ELECTRONIC DEVICE MANUFACTURING METHOD

The entire disclosure of Japanese Patent Application No: 2015-187840, filed Sep. 25, 2015 is expressly incorporated by reference herein in its entirety.

BACKGROUND

1. Technical Field

The present invention relates to an electronic device, a liquid ejecting head, and a manufacturing method for an electronic device employed, for example, to eject liquid from a liquid ejecting head such as an ink jet recording head. In particular, the invention relates to an electronic device, a liquid ejecting head, and an electronic device manufacturing method in which plural substrates are joined together using an adhesive.

2. Related Art

Electronic devices employed in liquid ejecting heads include those in which plural substrates are joined together in a stacked state using an adhesive. Such electronic devices are provided with liquid flow paths in communication with nozzles, and movable regions that cause pressure fluctuations in the liquid in the liquid flow paths so as to eject the liquid through the nozzles. For example, an ink jet recording head described in JP-A-11-227190 describes an electronic device stacked with a substrate formed with a pressure chamber, a diaphragm that blocks off one open face of the pressure chamber, and a piezoelectric element that displaces a movable region of the diaphragm corresponding to the pressure chamber. In this configuration, a silicon single crystal substrate (referred to simply as a silicon substrate below) is employed as the substrate formed with the pressure chamber, and the pressure chamber is formed by etching the silicon substrate. In a process in which a mask used in formation of the pressure chamber is removed by wet etching, the diaphragm (insulating film) revealed inside the pressure chamber is exposed to the etching liquid such that the diaphragm is also etched (isotropic etching) up to partway along its thickness direction. Side etching (undercutting) then advances to below walls bounding the pressure chamber, resulting in eave portions being formed at opening edges on the diaphragm side of the pressure chamber.

In the configuration described in JP-A-11-227190, the diaphragm undergoes side etching beyond the opening edges of the pressure chamber, thereby enlarging the area of the movable region of the diaphragm that is displaced by the drive of the piezoelectric elements by a commensurate amount in comparison to configurations in which the diaphragm is not etched (a configuration in which the area of the movable region is substantially the same as the area of a pressure chamber opening). The thickness of the movable region is moreover thinner than the thickness of other portions of the diaphragm. Damage such as cracking is thereby liable to occur in the diaphragm as a result of displacement of the movable region. Since the area and thickness of the portion that in effect functions as the movable region is dependent on etching precision, there is a possibility that variation could occur between the oscillation characteristics of respective movable regions (for example, the displacement amount and natural oscillation frequency when applied with a uniform external force).

SUMMARY

An advantage of some aspects of the invention is providing an electronic device, a liquid ejecting head, and an electronic device manufacturing method capable of suppressing damage such as cracking in a movable region, and capable of unifying oscillation characteristics.

An electronic device of an aspect of the invention includes plural substrates joined together in a stacked state, a space formed in one substrate out of the plural substrates, and a movable region configured by one face out of faces bounding the space. The movable region includes a recess indented from a space side to partway along a thickness direction of the movable region, and an internal dimension of the recess in a direction perpendicular to a substrate stacking direction is larger than an internal dimension of the space in the direction perpendicular to the substrate stacking direction. A wall bounding the space in the one substrate, and at least a portion of a bottom face of the recess, are adhered together by an adhesive.

According to the above configuration, the wall bounding the space in the one substrate, and at least a portion of the bottom face of the recess, are adhered together by the adhesive. The portion of the movable region that is adhered to the wall is thereby reinforced using the adhesive. The occurrence of damage such as cracks in the movable region due to displacement of the movable region is accordingly suppressed. Moreover, the adhesive in the recess forms a meniscus at uniform positions at boundary portions between a portion of the recess overlapping with the wall bounding the space in the substrate stacking direction, and other portions, and cures. The area of at least a portion that in effect functions as the movable region is accordingly aligned in each respective movable region. This thereby reduces the occurrence of variation between the oscillation characteristics of the movable regions as a result of enlarging the movable region during formation of the recess so as to be larger than the opening area of the space.

In the above configuration, a preferable configuration may be adopted in which adhesive between the one substrate and another substrate that is joined to a face of the one substrate on the opposite side to the movable region side, and adhesive adhering the wall and the bottom face of the recess together, are continuous to each other across the wall.

According to this configuration, adhesive from between the one substrate and the other substrate that has reached the recess across the wall can be utilized to reinforce the movable region. There is accordingly no need to provide separate materials or processes to reinforce the movable region.

In the above configuration, a preferable configuration may be adopted in which the adhesive is an organic compound containing an epoxide group.

According to this configuration, the adhesive has fluid properties at room temperature, thereby enabling adhesive from between the one substrate and the other substrate to more actively enter the recess across the wall under capillary force.

A liquid ejecting head of an aspect of the invention includes the electronic device of any one of the above configurations, a pressure chamber formed in the one substrate as the space in communication with a nozzle that ejects a liquid, and a piezoelectric element provided to displace a movable region bounding a portion of the pressure chamber.

According to this configuration, variation occurring between the oscillation characteristics of respective movable regions is reduced, thereby suppressing variation occurring between the ejection characteristics (ejection amount and airborne velocity) of liquid ejected from each respective nozzle.

An electronic device manufacturing method according to an aspect of the invention is a manufacturing method for an electronic device including plural substrates joined together in a stacked state and having a movable region configured by one face out of faces bounding a space formed in one substrate out of the plural substrates. The manufacturing method includes forming a recess having a larger internal dimension in a direction perpendicular to a substrate stacking direction than an internal dimension of the space in the direction perpendicular to the substrate stacking direction in a face on the space side of the movable region, and adhering a wall bounding the space in the one substrate to at least a portion of a bottom face of the recess using adhesive that is joining a face of the one substrate on the opposite side to the movable region side to another substrate and is leaking out from between the one substrate and the other substrate.

According to the above manufacturing method, adhesive from between the one substrate and the other substrate that has reached the recess across the wall can be utilized to reinforce the movable region, without providing separate materials or processes for reinforcement. The occurrence of damage such as cracks in the movable region due to displacement of the movable region is accordingly suppressed. Moreover, the adhesive in the recess forms a meniscus at uniform positions at boundary portions between a portion of the recess overlapping with the wall bounding the space in the substrate stacking direction, and other portions, and cures. The area of at least a portion that in effect functions as the movable region is accordingly aligned in each respective movable region. This thereby reduces the occurrence of variation between the oscillation characteristics of the movable regions as a result of enlarging the movable region during formation of the recess so as to be larger than the opening area of the space.

In the above method, the recess forming preferably includes forming a mask on the face of the one substrate on the opposite side to a face on the movable region side, the mask having an opening at a portion corresponding to the space, forming the space in the one substrate by etching the one substrate using the mask, and removing the mask using a mask removal liquid, and exposing the movable region that has been revealed at the space to the mask removal liquid.

Moreover, in the above method, preferably at least a face on the space side of the movable region is formed from silicon oxide, the mask is formed from silicon nitride, and the mask removal liquid is an aqueous solution of hydrogen fluoride.

Hitherto, heated phosphoric acid has been used as a removal liquid for a mask configured from silicon nitride, and a residue occurring as a result of this process has been removed using an aqueous solution of hydrogen fluoride. By contrast, according to the above manufacturing method, residue does not occur due to employing the aqueous solution of hydrogen fluoride to remove the mask. This thereby renders residue removal unnecessary.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an embodiment of the invention, with reference to the attached drawings. The embodiment described below includes various limitations as preferable specific examples of the invention. However, the scope of the invention is not limited thereby unless specifically indicated to be so in the following explanation.

Figure 1:
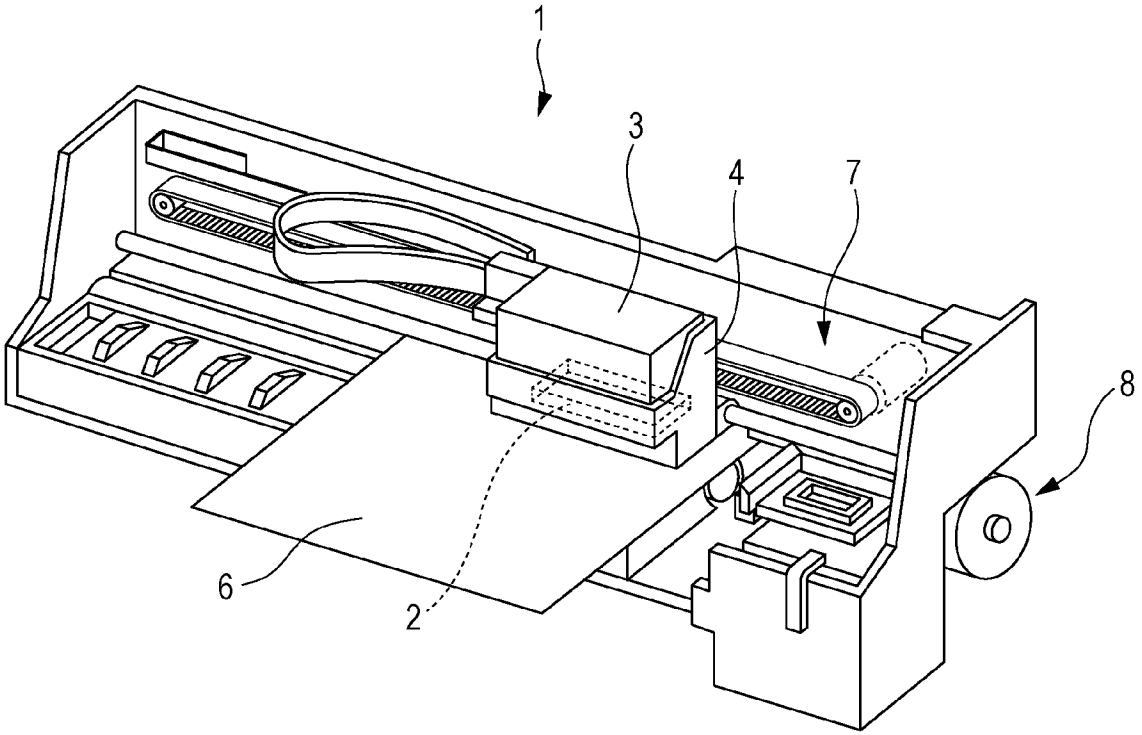
FIG. 1 is a perspective view to explain an internal configuration of a printer.

FIG. 1 is a perspective view illustrating an internal configuration of a printer 1 (a type of liquid ejecting device). The printer 1 includes a carriage 4 to which a recording head 2 (a type of liquid ejecting head) is attached, and to which an ink cartridge 3 serving as a liquid supply source is detachably attached, and a carriage mover mechanism 7 that reciprocally moves the carriage 4 in a paper width direction of recording paper 6, namely, in a main scanning direction. The printer 1 also includes a paper feed mechanism 8 that transports the recording paper 6 in a sub-scanning direction running orthogonal to the main scanning direction, and the like. The carriage 4 is configured so as to be moved in the main scanning direction by the carriage mover mechanism 7. The printer 1 records text, images, and the like on the recording paper 6 as the carriage 4 reciprocally moves, while sequentially transporting sheets of the recording paper 6. Note that configuration may be made in which the ink cartridge 3 is disposed on a main body side of the printer 1 rather than on the carriage 4 side, with ink inside the ink cartridge 3 being supplied to the recording head 2 side through ink supply tubes.

Figure 2:
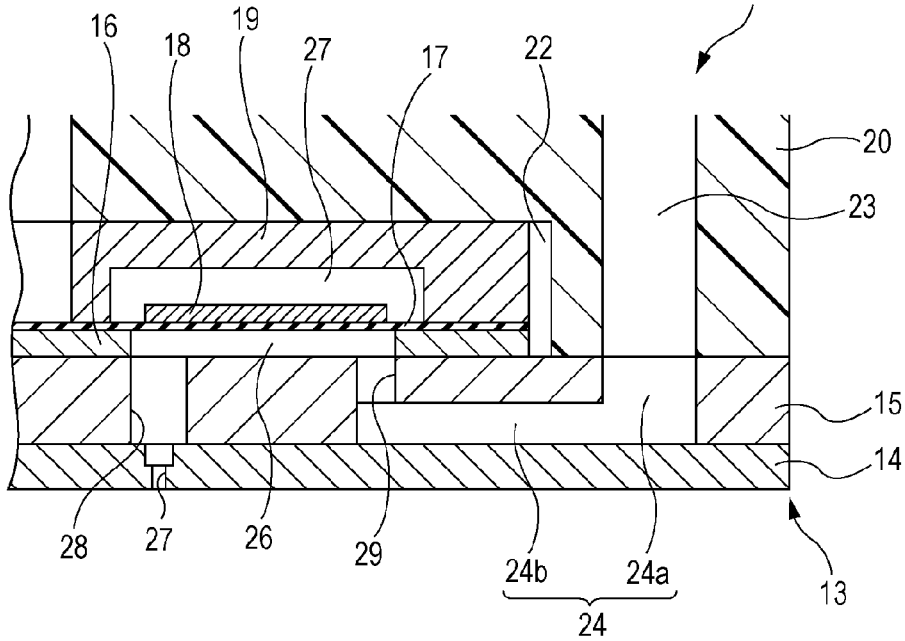
FIG. 2 is a cross-section to explain a configuration of a recording head.
Figure 3:
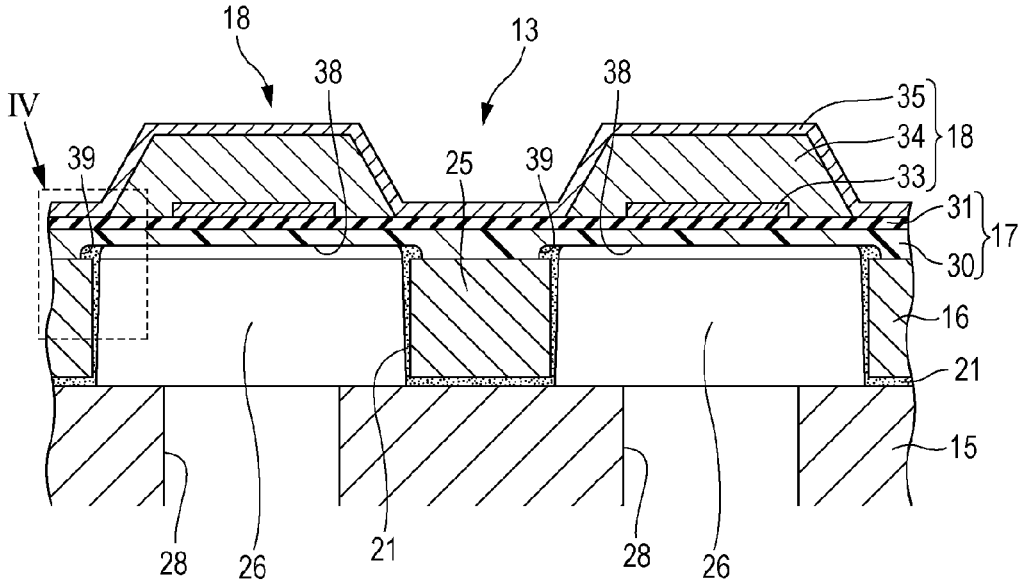
FIG. 3 is a cross-section of relevant portions, sectioned along a nozzle array direction of an electronic device.
Figure 4:
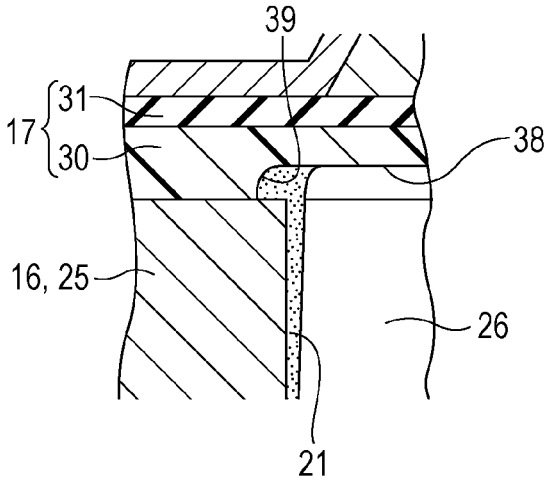
FIG. 4 is an enlarged cross-section of the region IV in FIG. 3.

FIG. 2 is a cross-section illustrating an internal configuration of the recording head 2. FIG. 3 is a cross-section of relevant portions, sectioned along a nozzle array direction of an electronic device 13. FIG. 4 is an enlargement of the region IV in FIG. 3. The recording head 2 of the present embodiment is a unit configured from plural substrates, specifically, a nozzle plate 14, a communication substrate 15 (corresponding to another substrate of the invention), and a pressure chamber formation substrate 16 (corresponding to one substrate of the invention), that are stacked in this sequence and joined together using an adhesive 21 (described later). The electronic device 13 is configured by stacking a diaphragm 17 and piezoelectric elements 18 (a type of actuator) on a face of the pressure chamber formation substrate 16 of the stacked body on the opposite side to the communication substrate 15 side. The recording head 2 is configured by attaching the electronic device 13 to a case 20 in a state in which a protective substrate 19 that protects the piezoelectric elements 18 is joined to an upper face of the electronic device 13.

The case 20 is a box shaped member made from a synthetic resin. The electronic device 13 is fixed to a bottom face side of the case 20. A lower face side of the case 20 is formed with a housing cavity 22 forming a cuboid shaped recess from the lower face to partway along a height direction of the case 20. When the electronic device 13 is joined to the lower face, the pressure chamber formation substrate 16, the diaphragm 17, the piezoelectric elements 18, and the protective substrate 19 of the electronic device 13 are housed inside the housing cavity 22. The case 20 is also formed with an ink entry path 23. Ink from the carriage mover mechanism 7 side enters a common liquid chamber 24 of the stacked structural body through the ink entry path 23.

The pressure chamber formation substrate 16 of the present embodiment is manufactured from a silicon single crystal substrate (also referred to simply as a silicon substrate below). Plural pressure chamber cavities bounding pressure chambers 26 (corresponding to a space of the invention) are formed in the pressure chamber formation substrate 16 by anisotropic etching corresponding to respective nozzles 27 of the nozzle plate 14. The pressure chamber formation substrate 16 of the present embodiment is manufactured from a silicon substrate having upper and lower faces are in (110) planes, and the pressure chamber cavities are through holes having side faces (inner walls) in (111) planes. One (an upper face side) opening of each pressure chamber cavity in the pressure chamber formation substrate 16 is closed off by the diaphragm 17. Moreover, the communication substrate 15 is joined to a face of the pressure chamber formation substrate 16 on the opposite side to the diaphragm 17, and another (lower face side) opening of each pressure chamber cavity is closed off by the communication substrate 15. The pressure chambers 26 are thereby bounded in this manner. In the following explanation, the pressure chamber cavities are also referred to as the pressure chambers 26. Note that portions of the diaphragm 17 that close off the upper openings of the pressure chambers 26 and bound one face of the respective pressure chambers 26 are movable regions, displaced by driving the piezoelectric elements 18. Note that configuration may be made in which the pressure chamber formation substrate 16 and the diaphragm 17 are integrated together. Namely, configuration may also be made in which the pressure chamber cavities are formed by etching from the lower face side of the pressure chamber formation substrate 16, and thinned portions with a thin thickness are left remaining at the upper face side, such that the thinned portions function as the movable regions.

The pressure chambers 26 of the present embodiment are elongated cavities running along a direction (second direction) orthogonal to a row direction of the nozzles 27 (the nozzle array direction, first direction). One length direction end portion of each of the pressure chambers 26 is in communication with the respective nozzle 27 through a nozzle communication opening 28 in the communication substrate 15. Another length direction end portion of each of the pressure chambers 26 is in communication with the common liquid chamber 24 through an individual communication opening 29 in the communication substrate 15. Plural of the pressure chambers 26 are provided in a row running along the nozzle array direction, separated by dividing walls 25 (corresponding to a wall bounding the space of the invention (see FIG. 3)) so as to correspond to the respective nozzles 27.

The communication substrate 15 is a plate member manufactured from a silicon substrate, similarly to the pressure chamber formation substrate 16. Anisotropic etching is used to form a cavity configuring the common liquid chamber 24 (also referred to as a reservoir or manifold), provided so as to be common to the plural pressure chambers 26 of the pressure chamber formation substrate 16, in the communication substrate 15. The common liquid chamber 24 is an elongated cavity running along the row direction of the respective pressure chambers 26 (the nozzle array direction, the first direction). The common liquid chamber 24 of the present embodiment is configured by a first liquid chamber 24*a* that penetrates the communication substrate 15 in its thickness direction, and a second liquid chamber 24*b* formed from a lower face side toward an upper face side of the communication substrate 15, up to partway through the thickness direction of the communication substrate 15 in a state leaving a thinned portion on the upper face side. One end portion of the second liquid chamber 24*b* in the second direction (an end portion on the side further from the nozzle 27) is in communication with the first liquid chamber 24*a*, and the other end portion of the second liquid chamber 24*b* in the same direction is formed at a position corresponding to below the pressure chambers 26. The other end portion of the second liquid chamber 24*b*, namely an edge portion on the opposite side to the first liquid chamber 24*a* side, is formed with plural of the individual communication openings 29 penetrating the thinned portion and provided along the first direction, corresponding to the respective pressure chambers 26 of the pressure chamber formation substrate 16. Lower ends of the individual communication openings 29 are in communication with the second liquid chamber 24*b*, and upper ends of the individual communication openings 29 are in communication with the respective pressure chambers 26 of the pressure chamber formation substrate 16.

The nozzle plate 14 is a plate member, through which the plural nozzles 27 are opened in a row pattern. In the present embodiment, the plural nozzles 27 are arrayed at a specific pitch to configure a nozzle row. In the present embodiment, the nozzle plate 14 is manufactured from a silicon substrate. Dry etching is used to form the plural circular cylinder shaped nozzles 27 in the nozzle plate 14. In the electronic device 13 of the present embodiment, ink flow paths are formed from the common liquid chamber 24 to the respective nozzles 27, through the individual communication openings 29, the pressure chambers 26, and the nozzle communication openings 28.

The diaphragm 17 formed on the upper face of the pressure chamber formation substrate 16 is configured by, for example, an elastic film 30 formed from silicon oxide ($SiO_2$), and an insulating film 31 formed from zirconium oxide ($ZrO_2$). As illustrated in FIG. 3 and FIG. 4, a lower face side (pressure chamber 26 side) of the elastic film 30 of the diaphragm 17 is formed with recesses 38 that are recessed from the lower face to partway along the thickness direction of the elastic film 30. The recesses 38 are formed by a process (described later) of removing a masking material employed during formation of the pressure chambers 26 in the pressure chamber formation substrate 16. As viewed along a substrate stacking direction, each of the recesses 38 has a greater area than the area of an upper opening of the respective pressure chambers 26. Namely, an internal dimension L1 of the recess 38 along a substrate plane direction (a direction orthogonal to the substrate stacking direction) is wider than an internal dimension L2 of the pressure chamber 26 along the same direction (see FIG. 10). Portions of the recesses 38 that overlap with the dividing walls 25 along the substrate stacking direction are referred to below as notch portions 39. Edges of the dividing walls 25 project out in eave shapes where they overlap with the notch portions 39 along the substrate stacking direction, and reach further toward an opening central side of the respective pressure chambers 26 than opening edges of the recesses 38. As illustrated in FIG. 3 and FIG. 4, in the notch portions 39, a portion of the adhesive 21 joining the pressure chamber formation substrate 16 and the communication substrate 15 together cures in a state in which it has flowed across the dividing walls 25. This point will be described in detail later.

The respective piezoelectric elements 18 are formed on the diaphragm 17 at positions corresponding to the upper openings of the pressure chambers 26, namely, on the movable regions. The piezoelectric elements 18 of the present embodiment are configured by successively stacking a lower electrode 33, a piezoelectric body 34, and an upper electrode 35 in that sequence from the diaphragm 17 side. In the present embodiment, the lower electrodes 33 are patterned corresponding to each of the pressure chambers 26, and function as individual electrodes of the piezoelectric elements 18. The upper electrode 35 is formed running continuously along the row direction of the respective pressure chambers 26 (first direction), and functions as a common electrode of the plural piezoelectric elements 18. In each of the piezoelectric elements 18, a region where the piezoelectric body 34 is interposed between the upper electrode 35 and the lower electrode 33 is a piezoelectric active section in which piezoelectric strain occurs when a voltage is applied across the two electrodes. In the following explanation, the piezoelectric element 18 refers to the piezoelectric active section. The piezoelectric elements 18 undergo flexural deformation according to changes in the applied voltage, such that the movable regions of the diaphragm 17 bounding one face of the respective pressure chambers 26 are displaced toward the side of the nozzles 27, or are displaced in a direction away from the nozzles 27. Pressure fluctuations accordingly arise in the ink inside the pressure chambers 26, and the ink is ejected from the nozzles 27 by these pressure fluctuations.

The nozzle plate 14, the communication substrate 15, and the pressure chamber formation substrate 16 that configure the electronic device 13 are joined together by the adhesive 21. The adhesive 21 is coated onto a transfer sheet before being transferred to joining faces of the substrates. An epoxy adhesive, this being an organic compound containing an epoxide group, is employed as the adhesive 21 of the present embodiment. Employing an epoxy adhesive as the adhesive 21 gives excellent joint strength and undergoes comparatively little contraction during curing, thereby enabling stable manufacture of the electronic device 13. As will be described later, prior to curing, epoxy adhesives have fluid properties at room temperature (for example, 25° C.), thereby enabling adhesive 21 that has leaked out from between the pressure chamber formation substrate 16 and the communication substrate 15 to actively enter the recesses 38.

FIG. 5 to FIG. 12 are process diagrams to explain manufacture of the electronic device 13 of the present embodiment. FIG. 5 to FIG. 12 are cross-sections sectioned along the nozzle array direction in the vicinity of the piezoelectric element 18 and the pressure chamber 26. In a manufacturing process of the electronic device 13 of the present embodiment, first, the elastic film 30 is formed on a surface of the silicon substrate, this being the material configuring the pressure chamber formation substrate 16. In this process, a front face of the silicon substrate is thermally oxidized, thereby forming the elastic film 30 from silicon oxide ($SiO_2$). Then, the insulating film 31 is formed superimposed on the elastic film 30 on one face (the upper face) of the pressure chamber formation substrate 16 (silicon substrate). In this process, for example, a zirconium layer (Zr) is formed by sputtering, before being thermally oxidized to form the insulating film 31 configured from zirconium oxide ($ZrO_2$). A close contact layer configured by a metal material such as iridium is also formed on the insulating film 31 as required. After forming the diaphragm 17 configured from the elastic film 30 and the insulating film 31 on the upper face of the pressure chamber formation substrate 16, the lower electrodes 33, the piezoelectric bodies 34, and the upper electrode 35 are formed as films in sequence on the diaphragm 17, thereby forming the piezoelectric element 18.

Figure 5:
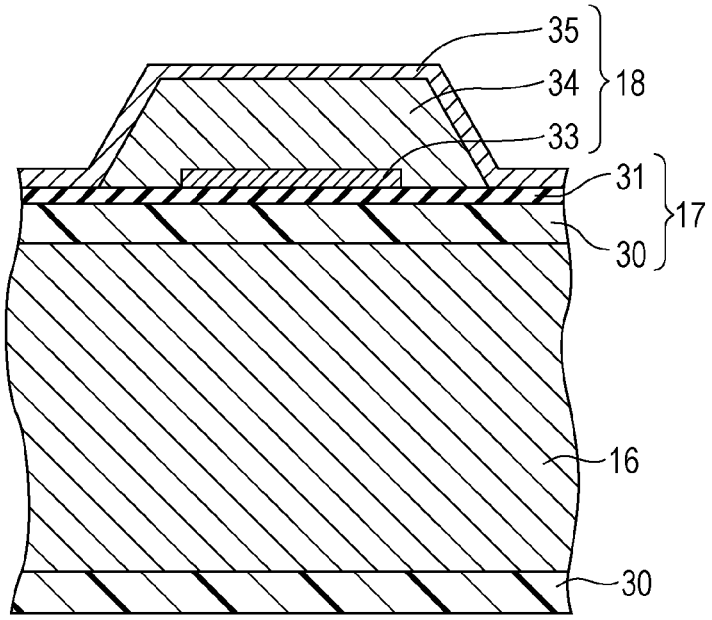
FIG. 5 is a process diagram to explain a manufacturing process of an electronic device.

After forming a film by sputtering, for example, the lower electrodes 33 are patterned so as to correspond to the respective pressure chambers 26. The piezoelectric bodies 34 are formed on the diaphragm 17 so as to cover the respective lower electrodes 33 after patterning. Specifically, the piezoelectric bodies 34 are formed from lead zirconate titanate (PZT). A specific procedure for forming the piezoelectric bodies 34 includes spin coating to coat the diaphragm 17 formed with the lower electrodes 33 with a sol (solution) containing the metallic organic substances that configure PZT, thereby forming a piezoelectric body precursor film. After forming the piezoelectric body precursor film, the piezoelectric body precursor film is sintered and crystallized by performing a drying process, a degreasing process, and a sintering process. After crystallization, the piezoelectric body precursor film is patterned using photolithography, and the individual piezoelectric bodies 34 are formed corresponding to the respective pressure chambers 26. After patterning the piezoelectric bodies 34, the entire face of the diaphragm 17 formed with the lower electrodes 33 and the piezoelectric bodies 34 is formed with a metal layer by sputtering or the like, and then patterned with a specific pattern, thereby forming the upper electrode 35 as a common electrode on the piezoelectric bodies 34. A protective film, not illustrated in the drawings, configured from aluminum oxide ($Al_2O_3$) or the like is then formed. The diaphragm 17 and the piezoelectric elements 18 are formed on the pressure chamber formation substrate 16 in this manner, as illustrated in FIG. 5.

Figure 6:
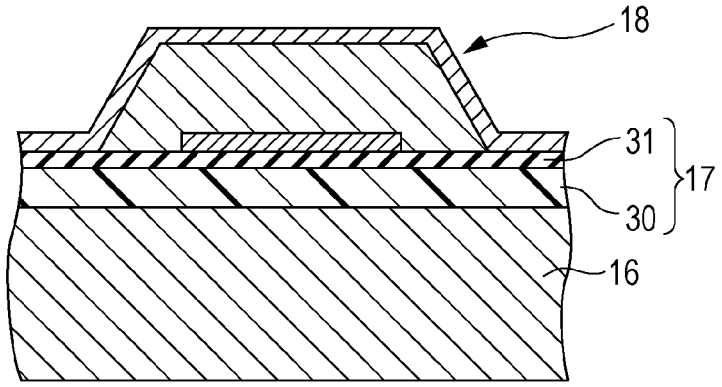
FIG. 6 is a process diagram to explain a manufacturing process of an electronic device.
Figure 7:
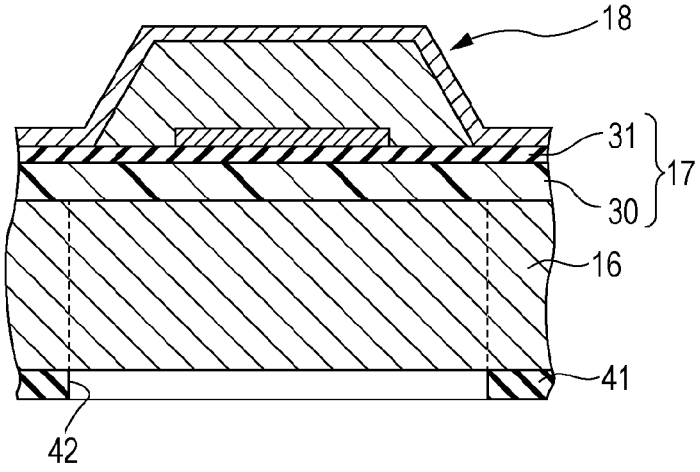
FIG. 7 is a process diagram to explain a manufacturing process of an electronic device.
Figure 8:
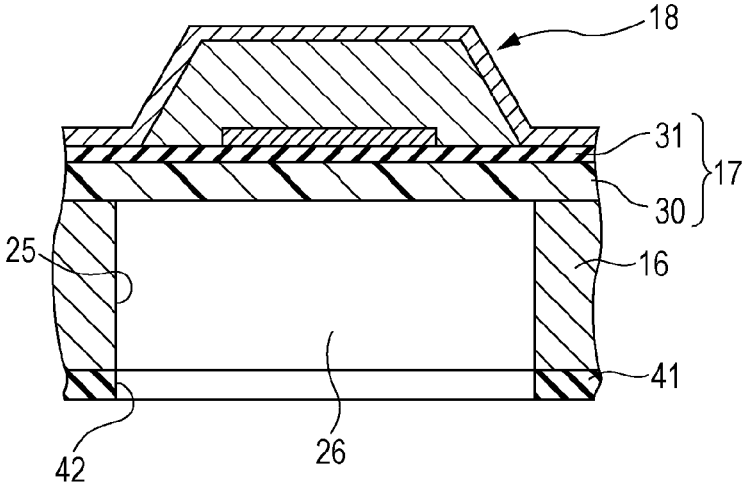
FIG. 8 is a process diagram to explain a manufacturing process of an electronic device.

Next, as illustrated in FIG. 6, another face (lower face) of the pressure chamber formation substrate 16, on the opposite side to the one face on the side formed with the diaphragm 17 and the piezoelectric element 18, is ground to adjust the pressure chamber formation substrate 16 to a specific thickness. After adjusting the thickness of the pressure chamber formation substrate 16, an etching solution of an aqueous solution of potassium hydroxide (KOH), for example, is used to perform anisotropic etching on the pressure chamber formation substrate 16 to form the spaces that will form the pressure chambers 26. Specifically, as illustrated in FIG. 7, a mask 41 is formed on the lower face of the pressure chamber formation substrate 16 by CVD or sputtering (mask forming process). Silicon nitride (SiN) is employed for the mask 41 of the present embodiment. Dry etching or the like is used to form openings 42 in the mask 41 at portions corresponding to the pressure chambers 26. Note that the portion of the pressure chamber formation substrate 16 illustrated by dashed lines in FIG. 7 is a location where the pressure chamber 26 will be formed. In this state, anisotropic etching is performed on the pressure chamber formation substrate 16 using the etching solution (space forming process). Since KOH has a very low etching rate with respect to (111) planes compared to its etching rate with respect to (110) planes, the etching advances along the thickness direction of the pressure chamber formation substrate 16, thereby forming the pressure chambers 26 with side faces (inner walls) in (111) planes as illustrated in FIG. 8.

Figure 9:
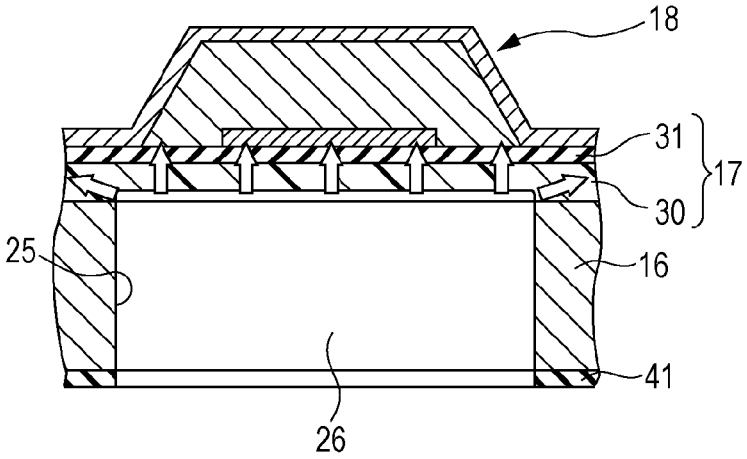
FIG. 9 is a process diagram to explain a manufacturing process of an electronic device.
Figure 10:
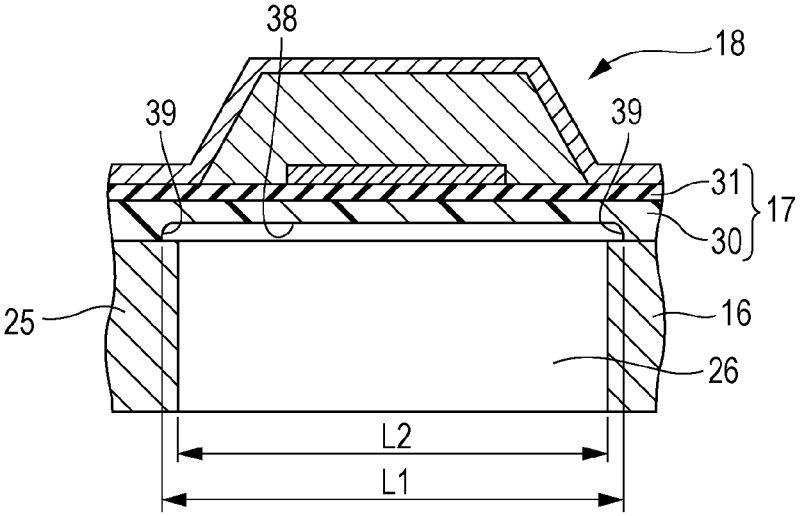
FIG. 10 is a process diagram to explain a manufacturing process of an electronic device.

Once the pressure chambers 26 have been formed, the mask 41 is then removed. In the mask removal process, hydrofluoric acid (HF) is employed as a removal agent for the silicon nitride (SiN) configuring the mask material. Hitherto, heated phosphoric acid has generally been employed as the removal agent for removing the silicon nitride configuring the mask material. However, heated phosphoric acid leaves a residue during the process of removing the silicon nitride. Accordingly, a separate residue removal process has hitherto been performed using hydrofluoric acid. By contrast, in the manufacturing process of the electronic device 13 according to the invention, it has been found that the mask 41 configured from silicon nitride can also be removed using hydrofluoric acid, thereby enabling hydrofluoric acid (an aqueous solution of hydrogen fluoride) to be employed as a mask removal liquid in place of heated phosphoric acid in the mask removal process. The residue removal process of hitherto is accordingly omitted, reducing costs. Note that in the mask removal process of the present embodiment, the silicon oxide elastic film 30 revealed inside the pressure chambers 26 is exposed to the aqueous solution of hydrogen fluoride, and as illustrated in FIG. 9, undergoes isotropic etching by the aqueous solution of hydrogen fluoride. By the time that the mask 41 has been completely removed, the elastic film 30 has undergone side etching up to positions overlapping with the dividing walls 25 bounding the pressure chambers 26 of the pressure chamber formation substrate 16 in the substrate stacking direction. Accordingly, as illustrated in FIG. 10, the notch portions 39 are formed at the portions of the recesses 38 that overlap with the dividing walls 25 in the substrate stacking direction. The recesses 38 are formed in the above manner by performing the mask forming process, the space forming process, and the mask removal process (recess forming process).

Note that although not explained in detail, the common liquid chamber 24, the individual communication openings 29, the nozzle communication openings 28, and the like are formed in the communication substrate 15 by anisotropic etching. The nozzles 27 are formed in the nozzle plate 14 by dry etching. The communication substrate 15 and the nozzle plate 14 are joined together by an adhesive in a state in which the nozzles 27 and the nozzle communication openings 28 have been positioned so as to be in communication with each other. A protective film is formed to inner walls of the flow paths of the pressure chambers 26 and the like using a material such as tantalum oxide ($Ta_2O_5$) or silicon oxide ($SiO_2$). This protective film exhibits lyophilic properties with respect to the ink.

Figure 11:
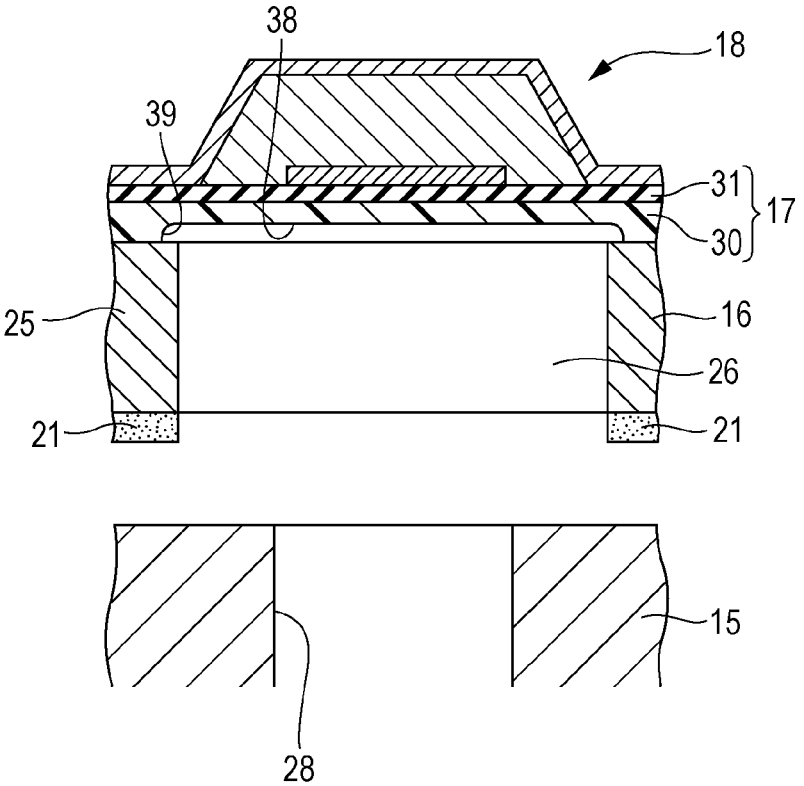
FIG. 11 is a process diagram to explain a manufacturing process of an electronic device.

A process to join the pressure chamber formation substrate 16 and the communication substrate 15 together is then performed. Specifically, first, as illustrated in FIG. 11, the adhesive 21 is transferred to the face of the pressure chamber formation substrate 16 to be joined to the communication substrate 15. Namely, a squeegee is used to coat the adhesive 21 to a specific thickness on a transfer sheet on a squeegee plate, not illustrated in the drawings, and the adhesive 21 coated on the transfer sheet is then transferred to the joining face of the pressure chamber formation substrate 16. The transfer sheet alone is then peeled off the pressure chamber formation substrate 16, such that, as illustrated in FIG. 11, the adhesive 21 is transferred to the joining face of the pressure chamber formation substrate 16 at a uniform thickness in regions other than the regions formed with the pressure chambers 26. Once the adhesive 21 has been transferred to the joining face of the pressure chamber formation substrate 16, the communication substrate 15 to be joined is stuck to the face to which the adhesive 21 has been transferred.

Figure 12:
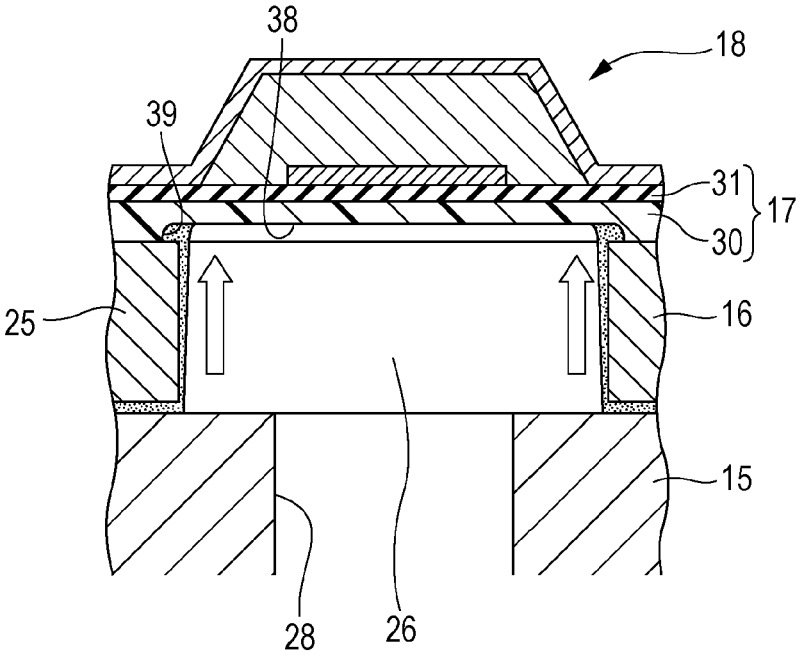
FIG. 12 is a process diagram to explain a manufacturing process of an electronic device.

As described above, in the present embodiment an epoxy adhesive with fluid properties is employed as the adhesive 21. Accordingly, when the adhesive 21 between the pressure chamber formation substrate 16 and the communication substrate 15 is squeezed, a portion of the adhesive 21 flows out from an adhesion region between the pressure chamber formation substrate 16 and the communication substrate 15 toward the side of the pressure chambers 26, as illustrated in FIG. 12. The adhesive 21 that has flowed out toward the side of the pressure chambers 26 then proceeds toward the side of the diaphragm 17 under capillary force at corners formed at intersections between side walls forming the pressure chambers 26 and the like (see the arrows in FIG. 12), reaching the recesses 38 of the diaphragm 17. The adhesive 21 that has reached the recesses 38 is led into the notch portions 39 by a similar capillary force. Namely, the fluid properties of the adhesive 21 can be utilized to actively lead the adhesive 21 from between the pressure chamber formation substrate 16 and the communication substrate 15 across the dividing walls 25 and toward the side of the recesses 38 under capillary force. Accordingly, the dividing walls 25 of the pressure chamber formation substrate 16 and at least a portion of the bottom faces of the recesses 38 are adhered together by the adhesive 21 (adhesion process). Once the pressure chamber formation substrate 16 and the communication substrate 15 have been stuck together, curing of the adhesive 21 is promoted by heating. In this manner, the respective substrates configuring the electronic device 13 are joined together to form a unit, and the ink flow paths to the nozzles 27 through the common liquid chamber 24, the individual communication openings 29, the pressure chambers 26, and the nozzle communication openings 28 are formed inside the electronic device 13.

Figure 13:
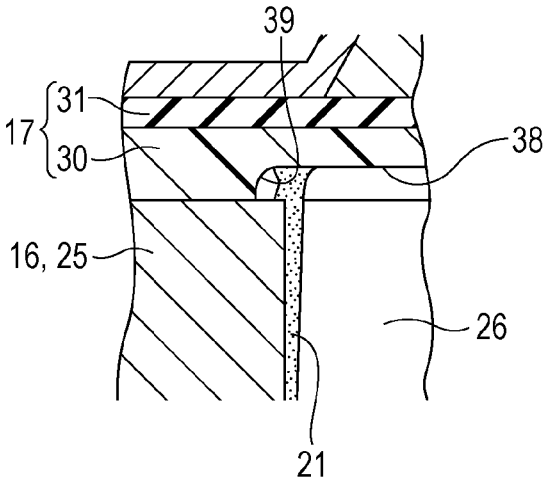
FIG. 13 is a cross-section of relevant portions of an electronic device of a modified example.

Note that in the electronic device 13 of the present embodiment, the adhesive 21 that has been led into the notch portions 39 of the recesses 38 adheres the dividing walls 25 and a portion of the bottom faces of the recesses 38 together, thereby reinforcing edge portions of the movable regions of the diaphragm 17 with the adhesive 21. Accordingly, even if the movable regions of the diaphragm 17 have been enlarged during the mask removal process, the occurrence of damage such as cracking of the movable regions (diaphragm 17) caused by displacement of the movable regions is suppressed. As long as there is no great variation in quantity, the adhesive 21 that has been led into the notch portions 39 forms a meniscus at uniform positions at boundary portions between the notch portions 39 of the recesses 38 and other portions, and cures. For example, in a modified example illustrated in FIG. 13, the adhesive 21 that has been led into the notch portion 39 has not reached the back of the notch portion 39 due to using a smaller quantity of the adhesive 21 than in the present embodiment. However, a meniscus is formed at a similar position to in the present embodiment. Accordingly, the area of at least the portions that in effect function as the movable regions (the portions that actually undergo displacement accompanying drive of the piezoelectric element 18) can be made substantially uniform. This accordingly reduces variation arising in the oscillation characteristics of the movable regions at each of the respective pressure chambers and each of the respective nozzles resulting from enlargement of the movable regions during etching. Variation in the ejection characteristics (ejection amount and airborne velocity) of the ink ejected from the respective nozzles 27 of the recording head 2 is thereby suppressed as a result.

In the present embodiment, the adhesive 21 between the pressure chamber formation substrate 16 and the communication substrate 15, and the adhesive 21 adhering the dividing walls 25 and the bottom faces of the recesses 38 together, is continuous across inner faces of the dividing walls 25 on the side of the pressure chambers. Namely, the adhesive 21 from between the pressure chamber formation substrate 16 and the communication substrate 15 that crosses the dividing walls 25 under capillary force to reach the recesses 38 can be utilized to reinforce the movable regions. There is accordingly no need to provide separate materials or processes to reinforce the movable regions.

Note that in the above explanation, explanation has been given regarding an example of a configuration in which ink, this being a type of liquid, is ejected from the nozzles by displacement of the movable regions bounding one face of the spaces (pressure chambers 26) formed in the one substrate (pressure chamber formation substrate 16). However, there is no limitation thereto, and the invention may be applied to any electronic device in which plural substrates are joined with an adhesive and that has a movable region. For example, the invention may be applied to sensors that use a movable region to detect pressure changes, vibration, displacement, or the like. Note that there is no limitation that a liquid must flow through the space with one face bounded by the movable region.

In the above embodiment, explanation has been given regarding an example in which the ink jet recording head 2 is employed as the liquid ejecting head. However, the invention may also be applied to other liquid ejecting heads having configurations formed with spaces such as liquid flow paths by joining plural substrates together with an adhesive. For example, the invention may be applied to colorant ejection heads employed in the manufacture of color filters for liquid crystal displays or the like, electrode material ejection heads employed in electrode formation in organic electro luminescence (EL) displays, field emission displays (FED) or the like, or bioorganic material ejection heads employed in the manufacture of biochips (biochemical devices). In colorant ejection heads for display manufacturing apparatus, solutions of respective Red (R), Green (G), and Blue (B) colorants, these being types of liquid, are ejected. In electrode material ejection heads for electrode forming apparatus, liquid electrode material, this being a type of liquid, is ejected. In bioorganic material ejection heads for chip manufacturing apparatus, a solution of bioorganic material, this being a type of liquid, is ejected.

What is claimed is:

1. An electronic device comprising:

a plurality of substrates joined together in a stacked state;

a space formed in a first substrate out of the plurality of substrates;

a movable region defined by a second substrate out of the plurality of substrates that is stacked on the first substrate and configured by a surface of the second substrate that forms a first face out of faces bounding the space;

the movable region including a recess indented from a space side to partway along a thickness direction of the movable region;

an internal dimension of the recess in a direction perpendicular to a substrate stacking direction being larger than an internal dimension of the space in the direction perpendicular to the substrate stacking direction; and a wall defined by the first substrate and bounding the space and a portion of the recess, being adhered together by an adhesive.

2. The electronic device of claim 1, wherein the adhesive between the first substrate and a third substrate out of the plurality of substrates that is joined to a face of the first substrate on the opposite side to the movable region side, and the adhesive adhering the wall and the recess together, are continuous to each other across the wall.

3. A liquid ejecting head comprising:

the electronic device of claim 2;

a pressure chamber formed in the one substrate as the space in communication with a nozzle that ejects a liquid; and a piezoelectric element provided to displace the movable region bounding a portion of the pressure chamber.

4. The electronic device of claim 1, wherein the adhesive is an organic compound containing an epoxide group.

5. A liquid ejecting head comprising:

the electronic device of claim 4;

a pressure chamber formed in the one substrate as the space in communication with a nozzle that ejects a liquid; and a piezoelectric element provided to displace the movable region bounding a portion of the pressure chamber.

6. A liquid ejecting head comprising:

the electronic device of claim 1;

a pressure chamber formed in the one substrate as the space in communication with a nozzle that ejects a liquid; and a piezoelectric element provided to displace the movable region bounding a portion of the pressure chamber.

* * * * *